US011348516B2

(12) United States Patent
Mao

(10) Patent No.: US 11,348,516 B2
(45) Date of Patent: May 31, 2022

(54) AMOLED PIXEL DRIVING CIRCUIT AND DRIVING METHOD

(71) Applicant: Wuhan China Star Optoelectronics Semiconductor Display Technology Co., Ltd., Wuhan (CN)

(72) Inventor: Peng Mao, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 723 days.

(21) Appl. No.: 16/320,473

(22) PCT Filed: Sep. 26, 2018

(86) PCT No.: PCT/CN2018/107769
§ 371 (c)(1),
(2) Date: Jan. 24, 2019

(87) PCT Pub. No.: WO2019/242147
PCT Pub. Date: Dec. 26, 2019

(65) Prior Publication Data

US 2022/0013066 A1 Jan. 13, 2022

(30) Foreign Application Priority Data

Jun. 22, 2018 (CN) ..... 201810651637.5

(51) Int. Cl.
*G09G 3/3233* (2016.01)

(52) U.S. Cl.
CPC ..... *G09G 3/3233* (2013.01); *G09G 2310/061* (2013.01); *G09G 2310/08* (2013.01); *G09G 2320/0233* (2013.01)

(58) Field of Classification Search
CPC ..... G09G 3/3233; G09G 2310/061; G09G 2310/08; G09G 2320/0233
See application file for complete search history.

(56) References Cited

U.S. PATENT DOCUMENTS

2014/0132642 A1* 5/2014 Wu ..... G09G 3/3258 345/690
2014/0253612 A1* 9/2014 Hwang ..... G09G 3/3258 345/691
2016/0042694 A1* 2/2016 Lim ..... G09G 3/3233 345/78
2017/0061868 A1* 3/2017 Tseng ..... G09G 3/3233
2017/0124954 A1* 5/2017 Park ..... H01L 27/3244
2017/0337875 A1* 11/2017 Jeon ..... H01L 27/1225
2018/0082647 A1* 3/2018 Nie ..... G09G 3/36
(Continued)

*Primary Examiner* — Jeff Piziali
(74) *Attorney, Agent, or Firm* — PV IP PC; Wei Te Chung; Ude Lu

(57) ABSTRACT

An AMOLED pixel driving circuit and a driving method are disclosed. The AMOLED pixel driving circuit adopts a 6T1C structure, wherein the thin-film transistor characteristic of the second thin film transistor is the same as that of the driving thin-film transistor, that is, the first thin-film transistor. Accordingly, the threshold voltage of the driving thin-film transistor can be compensated by the leakage current of the second thin-film transistor, so that the current flowing through the organic light emitting diode is stable, ensuring uniform brightness of the organic light emitting diode, and improving the display effect of the screen.

9 Claims, 4 Drawing Sheets

(56) References Cited

U.S. PATENT DOCUMENTS

| | | | | |
|---|---|---|---|---|
| 2018/0102397 | A1* | 4/2018 | Nie | H01L 27/3265 |
| 2018/0144685 | A1* | 5/2018 | Gong | G09G 3/3233 |
| 2018/0158406 | A1* | 6/2018 | Kim | G09G 3/3233 |
| 2018/0211592 | A1* | 7/2018 | Li | G09G 3/3233 |
| 2018/0240402 | A1* | 8/2018 | Nie | H01L 27/3248 |
| 2020/0410933 | A1* | 12/2020 | Kobayashi | G09G 3/3233 |

* cited by examiner

AMOLED PIXEL DRIVING CIRCUIT AND DRIVING METHOD

FIELD OF THE INVENTION

The present invention relates to a display technology field, and more particularly to an AMOLED pixel driving circuit and a driving method.

BACKGROUND OF THE INVENTION

An Organic Light Emitting Diode (OLED) display device has many advantages of self-luminous, low driving voltage, high luminous efficiency, short response time, high definition and contrast ratio, near 180° viewing angle, wide temperature range, capable of realizing flexible display and large-area full-color display such that the OLED display device has been recognized by the industry as the most promising display device.

The OLED display device can be divided into two types: the passive matrix OLED (PMOLED) and the active matrix OLED (AMOLED), namely two types of direct addressing and thin-film transistor (TFT) matrix addressing. Wherein the AMOLED has pixels arranged as a matrix, belongs to the active display type, and has high luminous efficiency, and is generally used as a high-definition large-sized display device.

The AMOLED is a current driving device. When a current flows through the organic light-emitting diode, the organic light-emitting diode emits a light, and the brightness of the light is determined by the current flowing through the organic light emitting diode itself. Most existing integrated circuits (ICs) only transmit voltage signals, so that the pixel driving circuit of AMOLED needs to complete a task of converting a voltage signal into a current signal. The conventional AMOLED pixel driving circuit is usually a 2T1C structure, that is, a structure having two thin-film transistors and a capacitor to convert a voltage into a current.

As shown in FIG. 1, a conventional 2T1C pixel driving circuit for an AMOLED includes a first P-type thin-film transistor T10, a second P-type thin-film transistor T20, and a capacitor C. The first P-type thin-film transistor T10 is a switching thin-film transistor, the second P-type thin-film transistor T20 is a driving thin-film transistor, and the capacitor C is a storage capacitor. Specifically, a gate of the first P-type thin-film transistor T10 is connected to the scanning signal Scan, a source is connected to the data signal Data, and a drain is electrically connected to a gate of the second P-type thin-film transistor T20 and one end of the capacitor C. A source of the second P-type thin-film transistor T20 is connected to the power supply voltage VDD, a drain is electrically connected to an anode of the organic light-emitting diode D; a cathode of the organic light-emitting diode D is grounded. One end of the capacitor C is electrically connected to the drain of the first P-type thin-film transistor T10, and the other end is electrically connected to the drain of the second P-type thin-film transistor T20. When the AMOLED is displayed, the scanning signal Scan controls the first P-type thin film transistor T10 to be turned on, and the data signal Data passes through the first P-type thin-film transistor T10 to enter the gate of the second P-type thin-film transistor T20 and the capacitor C, and then the first P-type thin-film transistor T10 is closed. Due to the storage function of the capacitor C, the gate voltage of the second P-type thin-film transistor T20 can continue to maintain the data signal voltage, so that the second P-type thin-film transistor T20 is in an on-state, and the driving current passes through the second P-type thin-film transistor T20 and enters the organic light-emitting diode D to drive the organic light-emitting diode D to emit a light.

The driving current of the OLED is controlled by a driving thin-film transistor, and the current is: $Ioled=K(Vgs-Vth)^2$, wherein K is the current amplification factor of the driving thin-film transistor, which is determined by the characteristics of the driving thin-film transistor itself, and Vgs is the driving thin-film transistor, Vgs is the gate-to-source voltage difference of the driving thin-film transistor, and Vth is the threshold voltage of the driving thin-film transistor. Since the threshold voltage of the driving thin-film transistor is easily drifted, these defects may cause the OLED driving current to fluctuate, causing the OLED panel to be defective and affecting the image quality.

SUMMARY OF THE INVENTION

An object of the present invention is to provide an AMOLED pixel driving circuit capable of effectively compensating for a threshold voltage of a driving thin-film transistor, stabilizing a current flowing through the organic light emitting diode, ensuring uniform brightness of the organic light emitting diode, and improving a display effect of the screen.

Another object of the present invention is to provide an AMOLED pixel driving method, which can effectively compensate the threshold voltage of the driving thin film transistor, stabilizing a current flowing through the organic light emitting diode, ensuring the uniform brightness of the organic light emitting diode, and improve the display effect of the screen.

In order to realize the above purpose, the present invention provides an AMOLED pixel driving circuit, comprising: a first thin-film transistor, a second thin-film transistor, a third thin-film transistor, a fourth thin-film transistor, a fifth thin-film transistor, and a sixth thin-film transistor, a capacitor and an organic light-emitting diode; wherein a gate of the first thin-film transistor is electrically connected to a first node, a source of the first thin-film transistor is electrically connected to a drain of the sixth thin-film transistor, and a drain of the first thin-film transistor is electrically connected to a second node; a gate and a source of the second thin-film transistor are electrically connected to the first node, and a drain of the second thin-film transistor is electrically connected to a drain of the third thin-film transistor; a gate of the third thin-film transistor is connected to a second scanning control signal, and a source of the third thin-film transistor is connected to a data signal; a gate of the fourth thin-film transistor is connected to a first scanning control signal, a source of the fourth thin-film transistor is connected to a reference voltage signal, and a drain of the fourth thin-film transistor is electrically connected to the first node; the fifth thin-film transistor is a dual gate thin-film transistor, and a first gate and a second gate of the fifth thin-film transistor are respectively connected to the first scanning control signal and the second scanning control signal, a source of the fifth thin-film transistor is electrically connected to the second node, a drain of the fifth thin-film transistor is connected to the power supply low voltage; a gate of the sixth thin-film transistor is connected to a light emission control signal, and a source of the sixth thin-film transistor T6 is connected to a power supply high voltage; two ends of the capacitor are electrically connected to the first node and the second node; an anode of the organic light-emitting diode is electrically connected to the second node, and a cathode of the organic light-emitting diode is connected to the power source low voltage; and characteristics of the first thin-film transistor and the second thin-film transistor are the same.

Wherein the first scanning control signal, the second scanning control signal, and the light emission control signal are combined to correspond to a reset phase, a data writing and compensation phase, and a light-emitting phase.

Wherein in the reset phase, the first scanning control signal controls the fourth thin-film transistor and the fifth thin-film transistor to be turned on, and the second scanning control signal controls the third thin-film transistor to be turned off, and the light emission control signal controls the sixth thin-film transistor to be turned off; in the data writing and compensation phase, the first scanning control signal controls the fourth thin-film transistor to be turned off, and the second scanning control signal controls the third thin-film transistor and the fifth thin-film transistor to be turned on, and the light emission control signal controls the sixth thin-film transistor to be turned off; and in the light-emitting phase, the first scanning control signal and the second scanning control signal control the fourth thin-film transistor, the third thin-film transistor, and the fifth thin-film transistor to be turned off, and the light emission control signal controls the sixth thin-film transistor to be turned on.

Wherein the first thin-film transistor, the second thin-film transistor, the third thin-film transistor, the fourth thin-film transistor, the fifth thin-film transistor, and the sixth thin-film transistor are all P-type thin-film transistors.

Wherein in the reset phase, the first scanning control signal is at a low voltage level, the second scanning control signal is at a high voltage level, and the light emission control signal is at a high voltage level; in the data writing and compensation phase, the first scanning control signal is at a high voltage level, the second scanning control signal is at a low voltage level, and the light emission control signal is at a high voltage level; in the light-emitting phase, the first scanning control signal is at a high voltage level, and the second scanning control signal is at a high voltage level and the light emission control signal is at a low voltage level.

Wherein the first thin-film transistor, the second thin-film transistor, the third thin-film transistor, the fourth thin-film transistor, the fifth thin-film transistor, and the sixth thin-film transistor are all low temperature polysilicon thin-film transistors, oxide semiconductor thin-film transistors or amorphous silicon thin-film transistors.

Wherein the first scanning control signal, the second scanning control signal, and the light emission control signal are all provided by an external timing controller.

Wherein the characteristic includes a threshold voltage of a thin-film transistor.

The present invention provides an AMOLED pixel driving method, which is applied to the AMOLED pixel driving circuit described above, and comprising following steps: step 100, entering a reset phase; wherein the first scanning control signal controls the fourth thin-film transistor and the fifth thin-film transistor to be turned on, and the second scanning control signal controls the third thin-film transistor to be turned off, and the light emission control signal controls the sixth thin-film transistor to be turned off, the reference voltage signal is written in the first node and stored in the capacitor; step 200, entering a data writing and compensating phase; wherein the first scanning control signal controls the fourth thin-film transistor to be turned off, and the second scanning control signal controls the third thin-film transistor and the fifth thin-film transistor to be turned on, and the light emission control signal controls the sixth thin-film transistor to be turned off; step 300, entering a light-emitting phase; wherein the first scanning control signal and the second scanning control signal control the fourth thin-film transistor, the third thin-film transistor, and the fifth thin-film transistor to be turned off, and the light emission control signal controls the sixth thin-film transistor to be turned on, and the organic light-emitting diode emits a light.

Advantageous effects of the present invention, the present invention provides an AMOLED pixel driving circuit that uses a pixel driving circuit of a 6T1C structure in which a thin-film transistor characteristic of a second thin-film transistor is the same as that of a driving thin-film transistor, that is, a first thin-film transistor. Therefore, the threshold voltage of the driving thin-film transistor can be compensated by the leakage current of the second thin-film transistor, the current flowing through the organic light-emitting diode can be stabilized, the light emitting brightness of the organic light emitting diode can be ensured, and the display effect of the screen can be improved. The invention also provides an AMOLED pixel driving method, which can effectively compensate the threshold voltage of the driving thin-film transistor, stabilize the current flowing through the organic light emitting diode, ensure the uniform brightness of the organic light emitting diode, and improve the display effect of the screen.

BRIEF DESCRIPTION OF THE DRAWINGS

In order to further understand the features and technical contents of the present invention, please refer to the following detailed description and drawings regarding the present invention. The drawings are provided for purposes of illustration and description only and are not intended to be limiting.

In the drawings.

DETAILED DESCRIPTION OF PREFERRED EMBODIMENTS

In order to further describe the technical means and effects of the present invention, the following detailed description will be made in conjunction with the preferred embodiments of the invention and the accompanying drawings.

Figure 1:
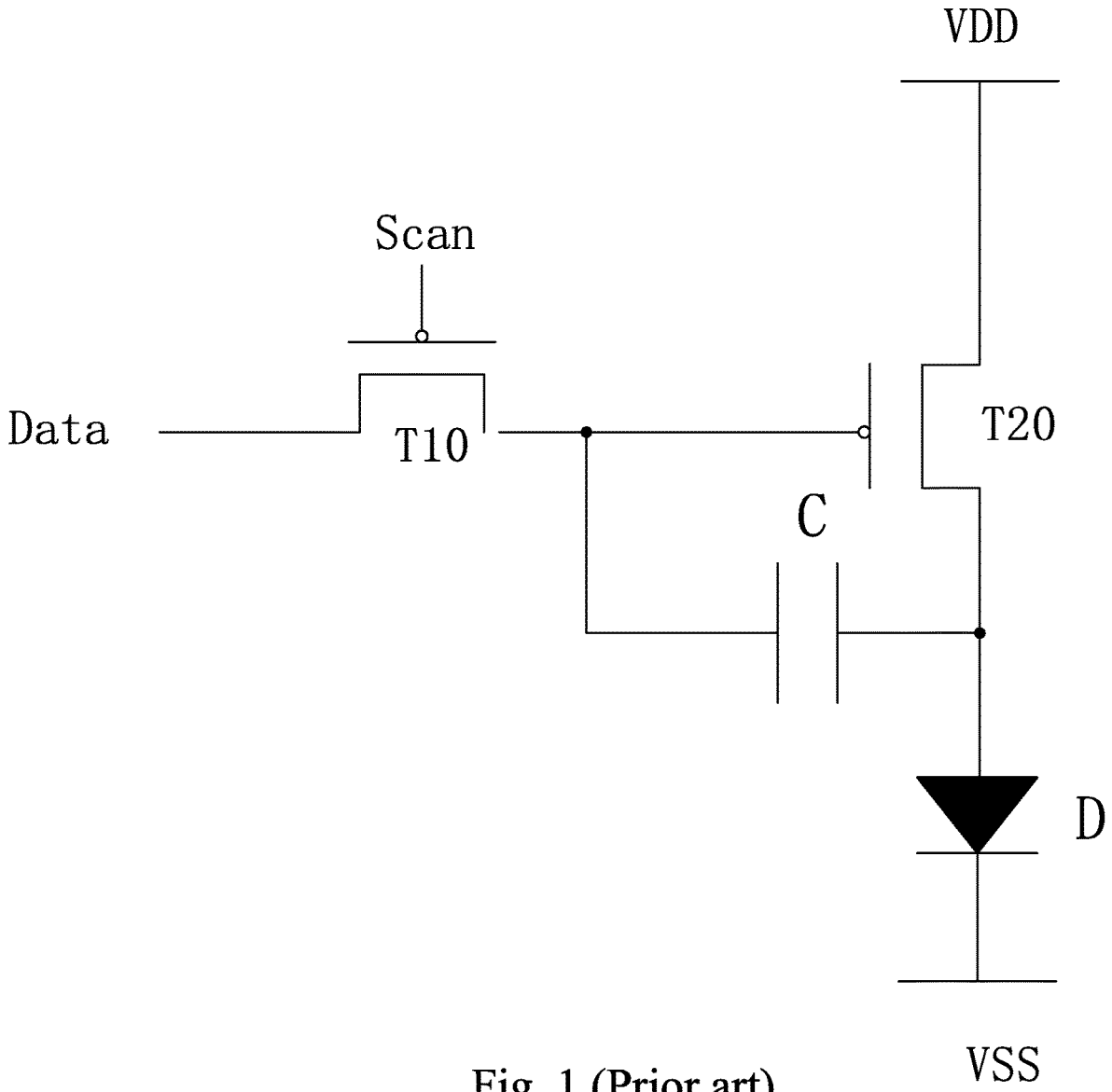
Fig. 1 (Prior art)
FIG. 1 is a circuit diagram of an AMOLED pixel driving circuit of the conventional art.
Figure 2:
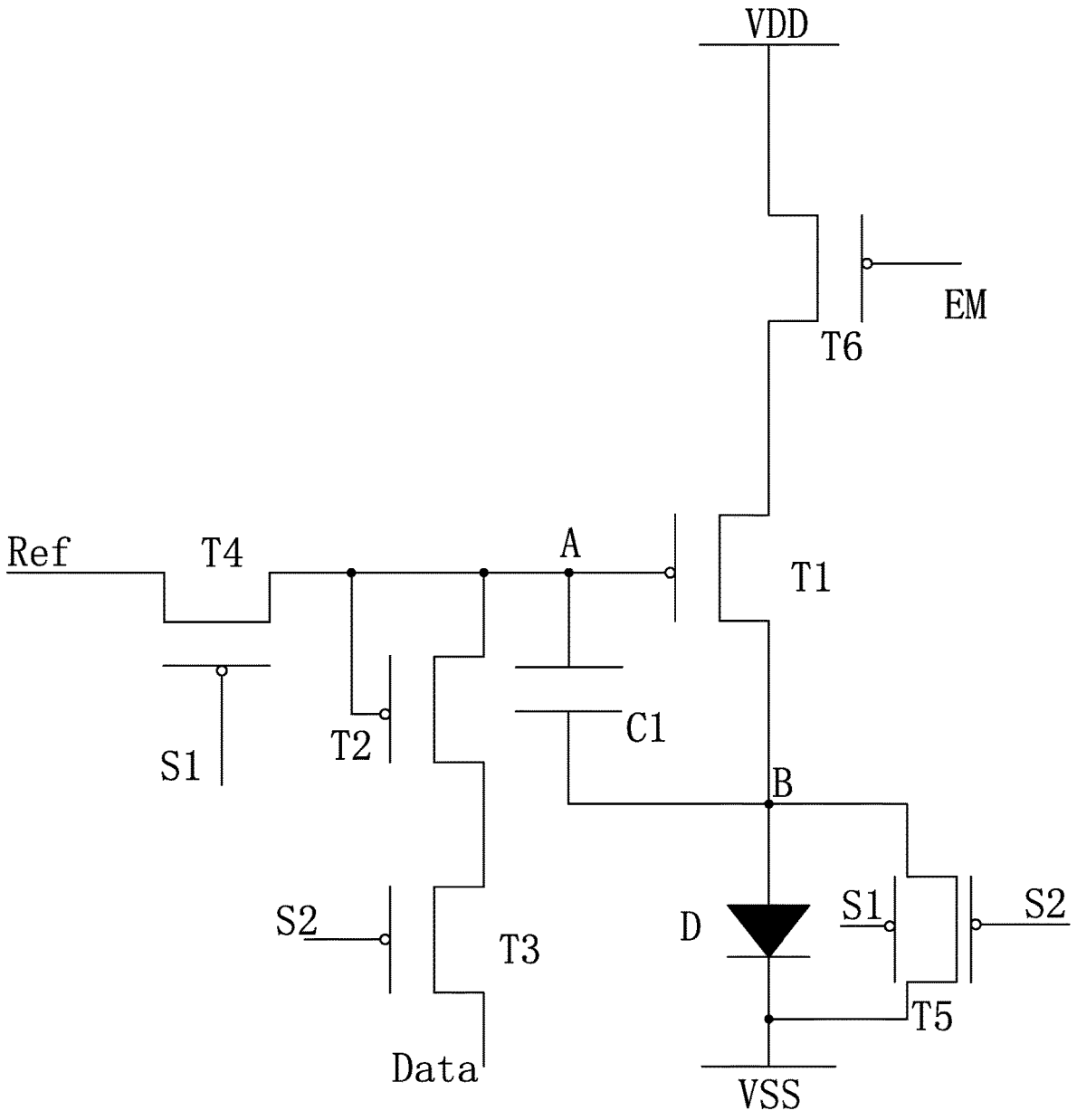
FIG. 2 is a circuit diagram of an AMOLED pixel driving circuit of the present invention.

Referring to FIG. 2, the present invention provides an AMOLED pixel driving circuit, including: a first thin-film transistor T1, a second thin-film transistor T2, a third thin-film transistor T3, a fourth thin-film transistor T4, a fifth thin-film transistor T5, and a sixth thin-film transistor T6, a capacitor C1 and an organic light-emitting diode D;

a gate of the first thin-film transistor T1 is electrically connected to a first node A, a source of the first thin-film transistor T1 is electrically connected to a drain of the sixth thin-film transistor T6, and a drain of the first thin-film transistor T1 is electrically connected to a second node B;

a gate and a source of the second thin-film transistor T2 are electrically connected to the first node A, and a drain of the second thin-film transistor T2 is electrically connected to a drain of the third thin-film transistor T3;

a gate of the third thin-film transistor T3 is connected to a second scanning control signal S2, and a source of the third thin-film transistor T3 is connected to a data signal Data;

a gate of the fourth thin-film transistor T4 is connected to a first scanning control signal S1, a source of the fourth thin-film transistor T4 is connected to a reference voltage signal Ref, and a drain of the fourth thin-film transistor T4 is electrically connected to the first node A;

the fifth thin-film transistor T5 is a dual gate thin-film transistor, and a first gate and a second gate of the fifth thin-film transistor T5 are respectively connected to the first scanning control signal S1 and the second scanning control signal S2, a source of the fifth thin-film transistor T5 is electrically connected to the second node B, a drain of the fifth thin-film transistor T5 is connected to the power supply low voltage VSS;

a gate of the sixth thin-film transistor T6 is connected to a light emission control signal EM, and a source of the sixth thin-film transistor T6 is connected to a power supply high voltage VDD;

two ends of the capacitor C1 are electrically connected to the first node A and the second node B, respectively;

an anode of the organic light-emitting diode D is electrically connected to the second node B, and a cathode of the organic light-emitting diode D is connected to the power source low voltage VSS;

thin-film transistor characteristics of the first thin-film transistor T1 and the second thin-film transistor T2 are the same.

Specifically, the above thin-film transistor characteristic includes: a threshold voltage of a thin-film transistor, and the same thin-film transistor characteristics of the first thin-film transistor T1 and the second thin-film transistor T2 specifically refer to a threshold voltage of the first thin-film transistor T1 and a threshold voltage of the second thin-film transistor T2 are the same.

Figure 3:
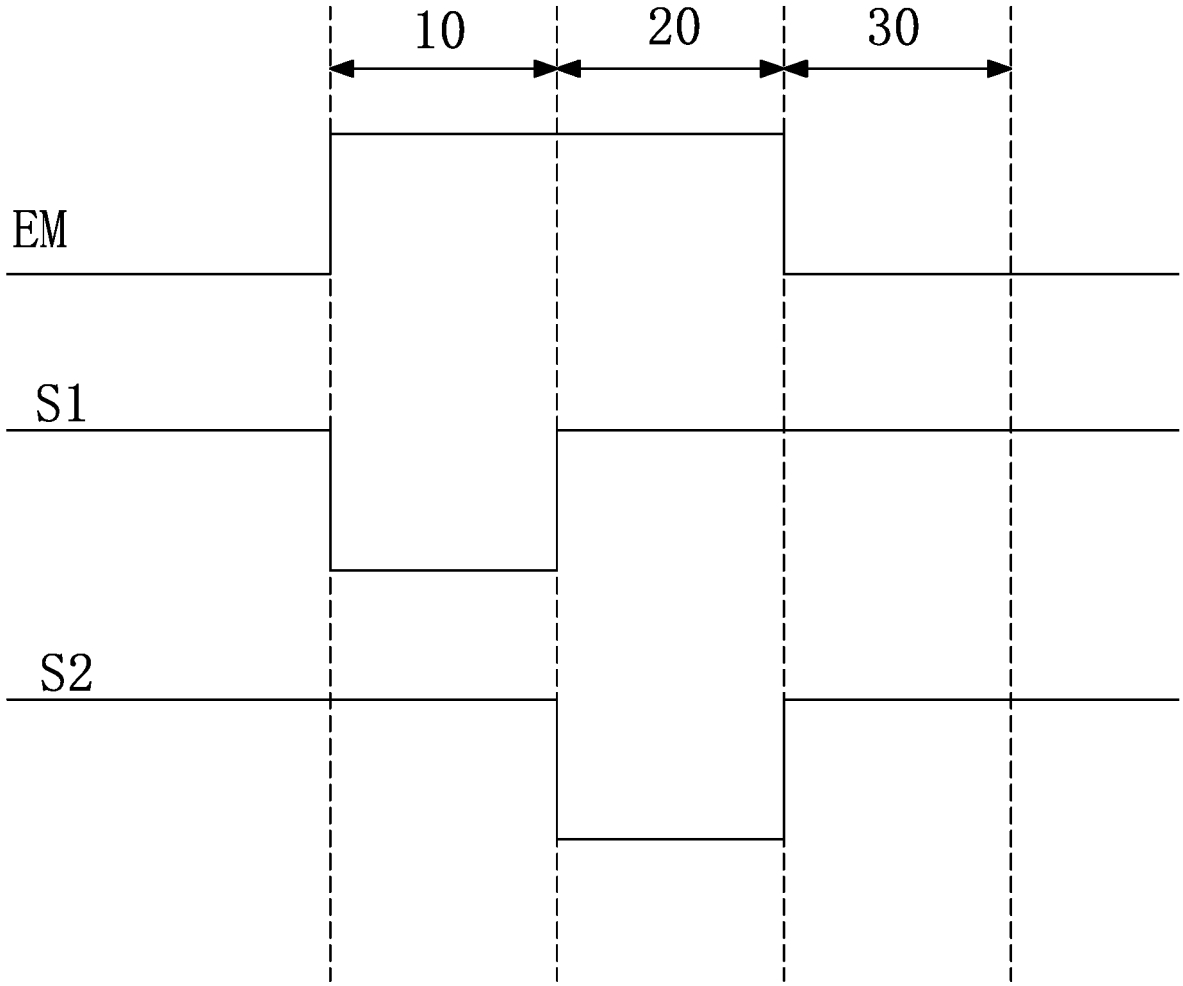
FIG. 3 is a timing diagram of an AMOLED pixel driving circuit of the present invention.

Specifically, as shown in FIG. 3, according to different voltage levels of the first scanning control signal S1, the second scanning control signal S2, and the light emission control signal EM, the operation process of the AMOLED pixel driving circuit of the present invention may be divided into: a reset phase 10, a data writing and compensation phase 20, and a light-emitting phase 30.

In the reset phase 10, the first scanning control signal S1 controls the fourth thin-film transistor T4 and the fifth thin-film transistor T5 to be turned on, and the second scanning control signal S2 controls the third thin-film transistor T3 to be turned off, and the light emission control signal EM controls the sixth thin-film transistor T6 to be turned off. At this time, the reference voltage signal Ref is written in the first node A and stored in the capacitor C1, the second thin-film transistor T2 is connected as a diode and the gate and the source of the second thin-film transistor T2 are reset to a voltage of the reference voltage signal Ref.

Furthermore, in the data writing and compensation phase 20, the first scanning control signal S1 controls the fourth thin-film transistor T4 to be turned off, and the second scanning control signal S2 controls the third thin-film transistor T3 and the fifth thin-film transistor T5 to be turned on. The light emission control signal EM controls the sixth thin-film transistor T6 to be turned off, and the data signal Data is written into the first node A such that the voltage level of the first node A becomes Vdata+Vth2, wherein Vdata is the voltage of the data signal Data, and Vth2 is the threshold voltage of the second thin-film transistor T2.

Wherein, in the data writing and compensation phase 20, the difference between the voltage of the data signal Data and the voltage of the reference voltage signal Ref is greater than the threshold voltage of the second thin-film transistor T2.

In the light-emitting phase 30, the first scanning control signal S1 and the second scanning control signal S2 control the fourth thin-film transistor T4, the third thin-film transistor T3, and the fifth thin-film transistor T5 to be turned off, and the light emission control signal EM controls the sixth thin-film transistor T6 to be turned on, a gate-source voltage of the first thin-film transistor T1 is Vdata+Vth−VDD, the first thin-film transistor T1 is turned on and the organic light-emitting diode D emits a light, and a current flowing through the organic light-emitting diode D is $I=K(Vdata+Vth2-VDD-Vth1)^2$, where Vth1 is the threshold voltage of the first thin-film transistor T1, since the threshold voltage of the first thin-film transistor T1 is the same as the threshold voltage of the second thin-film transistor T2, a current flowing through the organic light-emitting diode D is $I=K(Vdata-VDD)^2$, K is a current amplification factor of a driving thin-film transistor, which is determined by the characteristics of the driving thin-film transistor itself, so that the current flowing through the organic light-emitting diode D when the organic light-emitting diode D emits light and the threshold voltage of the first thin-film transistor T1 are independent. Accordingly, the present invention can solve the problem that the current flowing through the organic light emitting diode is unstable due to the threshold voltage drift of the driving thin-film transistor, so that the brightness of the light-emitting diode is uniform, which improves the display effect of the picture.

Preferably, the first thin-film transistor T1, the second thin-film transistor T2, the third thin-film transistor T3, the fourth thin-film transistor T4, the fifth thin-film transistor T5, and the sixth thin-film transistor T6 are all P-type thin-film transistors. At this time, in the reset phase 10, the first scanning control signal S1 is at a low voltage level, the second scanning control signal S2 is at a high voltage level, and the light emission control signal EM is at a high voltage level; in the data writing and compensation phase 20, the first scanning control signal S1 is at a high voltage level, the second scanning control signal S2 is at a low voltage level, and the light emission control signal EM is at a high voltage level; in the light-emitting phase 30, the first scanning control signal S1 is at a high voltage level, and the second scanning control signal S2 is at a high voltage level and the light emission control signal EM is at a low voltage level.

Preferably, the first thin-film transistor T1, the second thin-film transistor T2, the third thin-film transistor T3, the fourth thin-film transistor T4, the fifth thin-film transistor T5, and the sixth thin-film transistor T6 are all low temperature polysilicon thin-film transistors, oxide semiconductor thin-film transistors or amorphous silicon thin-film transistors.

Specifically, the first scanning control signal S1, the second scanning control signal S2, and the light emission control signal EM are all provided by an external timing controller.

Specifically, by providing the fifth thin-film transistor T5 as a dual gate thin-film transistor, the number of thin-film transistors required in the AMOLED pixel driving circuit can be reduced, the pixel driving circuit structure can be simplified, and the effective light emitting area can be increased.

Figure 4:
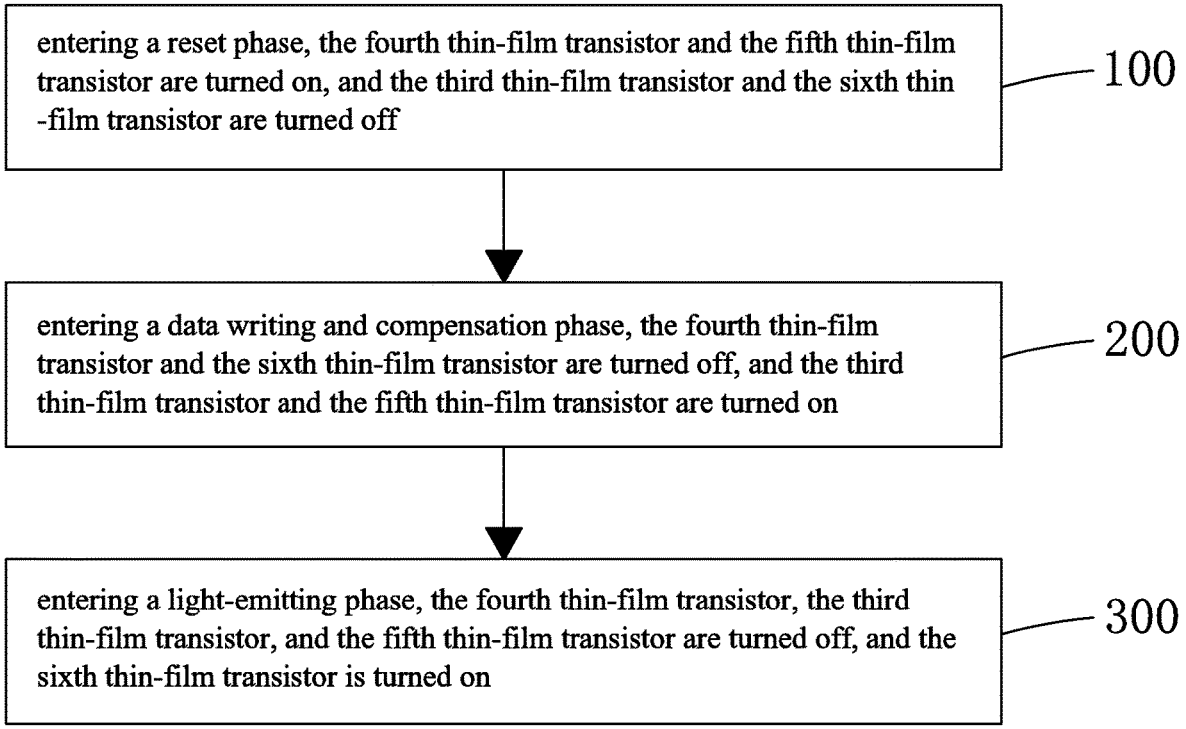
FIG. 4 is a flow chart of an AMOLED pixel driving circuit of the present invention.

Referring to FIG. 4, the present invention further provides an AMOLED pixel driving method, which is applied to the above AMOLED pixel driving circuit, and includes the following steps:

step 100, entering a reset phase 10;

the first scanning control signal S1 controls the fourth thin-film transistor T4 and the fifth thin-film transistor T5 to be turned on, and the second scanning control signal S2 controls the third thin-film transistor T3 to be turned off, and the light emission control signal EM controls the sixth thin-film transistor T6 to be turned off. At this time, the reference voltage signal Ref is written in the first node A and stored in the capacitor C1;

specifically, in the reset phase 10, the second thin-film transistor T2 is connected as a diode and the gate and the source of the second thin-film transistor T2 are reset to a voltage of the reference voltage signal Ref.

step 200, entering a data writing and compensation phase 20;

the first scanning control signal S1 controls the fourth thin-film transistor T4 to be turned off, and the second scanning control signal S2 controls the third thin-film transistor T3 and the fifth thin-film transistor T5 to be turned on, and the light emission control signal EM controls the sixth thin-film transistor T6 to be turned off, and the data signal Data is written into the first node A such that the voltage level of the first node A becomes Vdata+Vth2, wherein Vdata is the voltage of the data signal Data, and Vth2 is the threshold voltage of the second thin-film transistor T2;

wherein in the data writing and compensation phase 20, the difference between the voltage of the data signal Data and the voltage of the reference voltage signal Ref is greater than the threshold voltage of the second thin-film transistor T2.

step 300, entering a light-emitting phase 30;

the first scanning control signal S1 and the second scanning control signal S2 control the fourth thin-film transistor T4, the third thin-film transistor T3, and the fifth thin-film transistor T5 to be turned off, and the light emission control signal EM controls the sixth thin-film transistor T6 to be turned on, and the organic light-emitting diode D emits a light.

At this time, a gate-source voltage of the first thin-film transistor T1 is Vdata+Vth−VDD, the first thin-film transistor T1 is turned on and the organic light-emitting diode D emits a light, and a current flowing through the organic light-emitting diode D is $I=K\,(Vdata+Vth2-VDD-Vth1)^2$, where Vth1 is the threshold voltage of the first thin-film transistor T1, since the threshold voltage of the first thin-film transistor T1 is the same as the threshold voltage of the second thin-film transistor T2, a current flowing through the organic light-emitting diode D is $I=K(Vdata-VDD)^2$, so that the current flowing through the organic light-emitting diode D when the organic light-emitting diode D emits light and the threshold voltage of the first thin-film transistor T1 are independent. Accordingly, the present invention can solve the problem that the current flowing through the organic light emitting diode is unstable due to the threshold voltage drift of the driving thin-film transistor, so that the brightness of the light-emitting diode is uniform, which improves the display effect of the picture.

In summary, the present invention provides an AMOLED pixel driving circuit that uses a pixel driving circuit of a 6T1C structure in which a thin-film transistor characteristic of a second thin-film transistor is the same as that of a driving thin-film transistor, that is, a first thin-film transistor. Therefore, the threshold voltage of the driving thin-film transistor can be compensated by the leakage current of the second thin-film transistor, the current flowing through the organic light-emitting diode can be stabilized, the light emitting brightness of the organic light emitting diode can be ensured, and the display effect of the screen can be improved. The invention also provides an AMOLED pixel driving method, which can effectively compensate the threshold voltage of the driving thin-film transistor, stabilize the current flowing through the organic light emitting diode, ensure the uniform brightness of the organic light emitting diode, and improve the display effect of the screen.

As described above, for those of ordinary skill in the art, various other changes and modifications can be made in accordance with the technical solutions and the technical concept of the present invention, and all such changes and modifications are intended to fall within the scope of the appended claims.

What is claimed is:

1. An AMOLED pixel driving circuit, comprising: a first thin-film transistor, a second thin-film transistor, a third thin-film transistor, a fourth thin-film transistor, a fifth thin-film transistor, and a sixth thin-film transistor, a capacitor and an organic light-emitting diode;

wherein a gate of the first thin-film transistor is electrically connected to a first node, a source of the first thin-film transistor is electrically connected to a drain of the sixth thin-film transistor, and a drain of the first thin-film transistor is electrically connected to a second node;

a gate and a source of the second thin-film transistor are electrically connected to the first node, and a drain of the second thin-film transistor is electrically connected to a drain of the third thin-film transistor;

a gate of the third thin-film transistor is connected to a second scanning control signal, and a source of the third thin-film transistor is connected to a data signal;

a gate of the fourth thin-film transistor is connected to a first scanning control signal, a source of the fourth thin-film transistor is connected to a reference voltage signal, and a drain of the fourth thin-film transistor is electrically connected to the first node;

the fifth thin-film transistor is a dual gate thin-film transistor, and a first gate and a second gate of the fifth thin-film transistor are respectively connected to the first scanning control signal and the second scanning control signal, a source of the fifth thin-film transistor is electrically connected to the second node, a drain of the fifth thin-film transistor is connected to a first power-supply voltage;

a gate of the sixth thin-film transistor is connected to a light emission control signal, and a source of the sixth thin-film transistor is connected to a second power-supply voltage;

two ends of the capacitor are electrically connected to the first node and the second node;

an anode of the organic light-emitting diode is electrically connected to the second node, and a cathode of the organic light-emitting diode is connected to the first power-supply voltage; and characteristics of the first thin-film transistor and the second thin-film transistor are the same, wherein the second thin-film transistor is connected as a diode between the gate of the first thin-film transistor and the third film-film transistor such that the second thin-film transistor exhibits a threshold voltage to selectively set a potential of the first node to a sum of the data signal and the threshold voltage of the second thin-film transistor.

2. The AMOLED pixel driving circuit according to claim 1, wherein the first scanning control signal, the second scanning control signal, and the light emission control signal are combined to correspond to a reset phase, a data writing and compensation phase, and a light-emitting phase.

3. The AMOLED pixel driving circuit according to claim 2, wherein in the reset phase, the first scanning control signal controls the fourth thin-film transistor and the fifth thin-film transistor to be turned on, and the second scanning control signal controls the third thin-film transistor to be turned off, and the light emission control signal controls the sixth thin-film transistor to be turned off;

in the data writing and compensation phase, the first scanning control signal controls the fourth thin-film transistor to be turned off, and the second scanning control signal controls the third thin-film transistor and the fifth thin-film transistor to be turned on, and the light emission control signal controls the sixth thin-film transistor to be turned off; and in the light-emitting phase, the first scanning control signal and the second scanning control signal control the fourth thin-film transistor, the third thin-film transistor, and the fifth thin-film transistor to be turned off, and the light emission control signal controls the sixth thin-film transistor to be turned on.

4. The AMOLED pixel driving circuit according to claim 3, wherein the first thin-film transistor, the second thin-film transistor, the third thin-film transistor, the fourth thin-film transistor, the fifth thin-film transistor, and the sixth thin-film transistor are all P-type thin-film transistors.

5. The AMOLED pixel driving circuit according to claim 4, wherein each of the first scanning control signal, the second scanning control signal, and the light emission control signal includes a first voltage level and a second voltage level that is higher than the first voltage level, and wherein in the reset phase, the first scanning control signal is at the first voltage level, the second scanning control signal is at the second voltage level, and the light emission control signal is at the second voltage level;

in the data writing and compensation phase, the first scanning control signal is at the second voltage level, the second scanning control signal is at the first voltage level, and the light emission control signal is at the second voltage level; and in the light-emitting phase, the first scanning control signal is at the second voltage level, and the second scanning control signal is at the second voltage level and the light emission control signal is at the first voltage level.

6. The AMOLED pixel driving circuit according to claim 1, wherein the first thin-film transistor, the second thin-film transistor, the third thin-film transistor, the fourth thin-film transistor, the fifth thin-film transistor, and the sixth thin-film transistor are all low-temperature polysilicon thin-film transistors, oxide semiconductor thin-film transistors or amorphous silicon thin-film transistors.

7. The AMOLED pixel driving circuit according to claim 1, wherein the first scanning control signal, the second scanning control signal, and the light emission control signal are all provided by an external timing controller.

8. The AMOLED pixel driving circuit according to claim 1, wherein the characteristics of the first thin-film transistor and the second thin-film transistors include a threshold voltage of the first thin-film transistor and a threshold voltage of the second thin-film transistor.

9. An AMOLED pixel driving method, which is applied to the AMOLED pixel driving circuit as claimed in claim 1, and comprising steps of:

step 100, entering a reset phase;

wherein the first scanning control signal controls the fourth thin-film transistor and the fifth thin-film transistor to be turned on, and the second scanning control signal controls the third thin-film transistor to be turned off, and the light emission control signal controls the sixth thin-film transistor to be turned off, the reference voltage signal is written in the first node and stored in the capacitor;

step 200, entering a data writing and compensation phase;

wherein the first scanning control signal controls the fourth thin-film transistor to be turned off, and the second scanning control signal controls the third thin-film transistor and the fifth thin-film transistor to be turned on, and the light emission control signal controls the sixth thin-film transistor to be turned off;

step 300, entering a light-emitting phase;

wherein the first scanning control signal and the second scanning control signal control the fourth thin-film transistor, the third thin-film transistor, and the fifth thin-film transistor to be turned off, and the light emission control signal controls the sixth thin-film transistor to be turned on, and the organic light-emitting diode emits a light.

* * * * *